United States Patent [19]

Cohen

[11] Patent Number: 4,637,181

[45] Date of Patent: Jan. 20, 1987

[54] ELEVATED WATERPROOF ACCESS FLOOR SYSTEM AND METHOD OF MAKING THE SAME

[75] Inventor: Marc M. Cohen, Palo Alto, Calif.

[73] Assignee: The United States of America as represented by the Administrator of the National Aeronautics and Space Administration, Washington, D.C.

[21] Appl. No.: 500,046

[22] Filed: Jun. 1, 1983

[51] Int. Cl.[4] ..... E04S 5/58

[52] U.S. Cl. ..... 52/126.5; 52/309.15; 52/391; 52/511; 52/814

[58] Field of Search ..... 52/126.1, 126.2, 126.5, 52/126.6, 262, 810, 813, 814, 386, 391, 510, 511, 596, 597, 598, 384, 506, 309.8, 309.9, 309.11, 408, 309.15; 404/18, 35

[56] References Cited

U.S. PATENT DOCUMENTS

| | | | |
|---|---|---|---|
| 646,589 | 4/1900 | Wess | 52/596 |
| 871,420 | 11/1907 | Kohout | 52/384 |
| 1,960,949 | 5/1934 | Miller et al. | 52/511 |
| 2,270,114 | 1/1942 | Duncan | 52/598 |
| 2,735,166 | 2/1956 | Hoseason | 52/126.2 |
| 2,797,448 | 7/1957 | Revell | 52/598 |
| 3,676,971 | 7/1972 | Dombroski | 52/386 |
| 3,851,674 | 12/1974 | Fork | 52/126.2 |
| 3,946,529 | 3/1976 | Chevaux | 52/506 |
| 3,953,950 | 5/1976 | Sudyk | 52/506 |
| 4,085,557 | 4/1978 | Tharp | 52/126.6 |
| 4,447,998 | 5/1984 | Griffen | 52/126.6 |

FOREIGN PATENT DOCUMENTS

| | | | |
|---|---|---|---|
| 1359353 | 3/1964 | France | 52/126.6 |
| 201552 | 12/1938 | Switzerland | 52/386 |
| 589195 | 6/1977 | Switzerland | 52/126.1 |
| 537385 | 6/1941 | United Kingdom | 52/597 |
| 1266963 | 3/1972 | United Kingdom | 52/126.6 |

*Primary Examiner*—John E. Murtagh
*Assistant Examiner*—Andrew Joseph Rudy
*Attorney, Agent, or Firm*—Darrell G. Brekke; John R. Manning; Robert D. Marchant

[57] ABSTRACT

An elevated waterproof access floor system having subfloor channels or compartments for power lines, gas lines or the like is adapted such that it can be opened and subsequently resealed without destroying the waterproofing and without destroying its aesthetic appearance. A multiplicity of tiles are supported on a support grid, and a flooring sheet is supported on the tiles. Attachment means are provided to prevent lateral but non vertical movement of the flooring sheet with respect to the tiles so that the flooring sheet can be lifted off the tiles, but when the flooring sheet is supported on the tiles, no lateral slipping will occur. The flooring sheet is made of a heat resealable material, so that it can be cut away in sections, and the tiles therebelow lifted off, to provide access to subfloor compartments. The heat-resealable flooring sheet can be resealed after penetration, to yield flooring system in which waterproofing and aesthetic appearance are maintained even after penetration. A method of assembling such a waterproof elevated floor system includes laying the tiles on a support grid, applying an anti-adhesive coating to the tiles, placing an attachment element into recesses formed on the tiles, placing an adhesive substance on the top surface of the attachment elements, and placing a flooring sheet across the tiles such that the flooring sheet is bonded to the attachment element by the adhesive substance thereon.

10 Claims, 5 Drawing Figures

ELEVATED WATERPROOF ACCESS FLOOR SYSTEM AND METHOD OF MAKING THE SAME

ORIGIN OF THE INVENTION

The invention described herein was made by an employee of the United States Government and may be manufactured and used by or for the Government for governmental purposes without the payment of any royalties thereon or therefor.

TECHNICAL FIELD OF THE INVENTION

The present invention relates to elevated access floor systems in which channels or compartments are provided under the floor to accommodate power lines, gas lines, water lines, coaxial cables or other similar lines.

BACKGROUND

In elevated access floor systems, it is advantageous to provide access to the subfloor cavities in order to reroute existing fluid or electrical line or add new ones. Further, it would be advantageous to provide a waterproof elevated access floor system wherein the floor can be penetrated and resealed without destroying the waterproofing and without destroying the aesthetic appearance of the floor.

In conventional systems, computer equipment is stationed on an elevated access floor which is surfaced with laminated tile or carpet. Such a floor is not waterproof. Further, when a repair or change must be made in the compartments below the floor, a hole is cut in the tile or carpet, and the cutout segment is later merely dropped back in place, thus destroying the aesthetic appearance of the floor.

There are no heretofore known waterproof access floor systems which can be penetrated and resealed in a satisfactory manner.

It is therefore an object of the present invention to provide an elevated access floor system which provides easy access to subfloor compartments, is waterproof and whose aesthetic appearance is not destroyed by penetration thereof.

It is another object of the present invention to provide a method of assembling such an elevated waterproof access floor system.

BRIEF SUMMARY OF THE INVENTION

According to the present invention, an elevated waterproof access floor system is adapted such that it can be opened and then resealed in a waterproof fashion without destroying the waterproofing or the aesthetic appearance of the floor.

A floor system in accordance with the present invention has a support grid, a plurality of tiles or other flooring elements supported on the support grid, and a flooring sheet supported on the tiles. The system further has attachment means adapted to prevent lateral but not vertical movement of the flooring sheet with respect to the tiles. The flooring sheet is made of a heat-resealable material. The flooring sheet can be made of a sheet vinyl such as polyvinyl chloride. The attachment means can have a combination of at least one recess formed in the upper surface of at least one of the tiles, and at least one attachment element attached ot the flooring sheet such that when the flooring sheet is supported across the tiles, the at least one attachment element fits into the at least one recess to prevent lateral movement of the flooring sheet with respect to the tiles. A recess can be formed in each tile, and a plurality of attachment elements can be attached to the flooring sheet such that an attachment element fits into each recess. The attachment elements can be attached to the sheet by adhesive means. The upper surfaces of the tiles, except at the recesses, can be coated with a substance to prevent adhesion between the flooring sheet and the tiles. The coating substance can be a light oil. The tiles can have a resilient edging to enable them to tightly fit against each other. The tiles can have either a wood or a plastic core, and can have a metal exterior. The support grid can be a plurality of pedestals having stringers supported thereon. The pedestals can be vertically adjustable. The grid can be provided on the upper surface of the flooring sheet such that the grid coincides with the borders of the tiles.

Further, according to the present invention, a method of assembling an elevated waterproof access floor system is provided. The method includes: (1) disposing a plurality of tiles on a support grid, where at least one of the tiles have a recess formed in its upper surface; (2) disposing a substance on top of the tile surfaces to prevent adhesion; (3) disposing an attachment element into the at least one recess; (4) disposing an adhesive substance on the top surface of the attachment elements; and (5) disposing a flooring sheet across the tiles such that the flooring sheet is bonded to the attachment element by the adhesive substance, whereby the attachment element prevents lateral but not vertical displacement between the tiles and the flooring sheet and whereby the substance capable of preventing adhesion prevents adhesion between the tiles and the flooring sheet. The method can also provide for a grid on the upper surface of the flooring sheet wherein the grid coincides with the borders of the tiles. The method can also provide for coating the upper surfaces of the tiles, but not the attachment element, with a substance capable of preventing adhesion. The "anti-adhesive" material can be a light oil.

BRIEF DESCRIPTION OF THE DRAWINGS

Embodiments of the present invention are shown by way of example in the accompanying drawings, wherein.

DETAILED DESCRIPTION OF THE INVENTION

Figure 1:
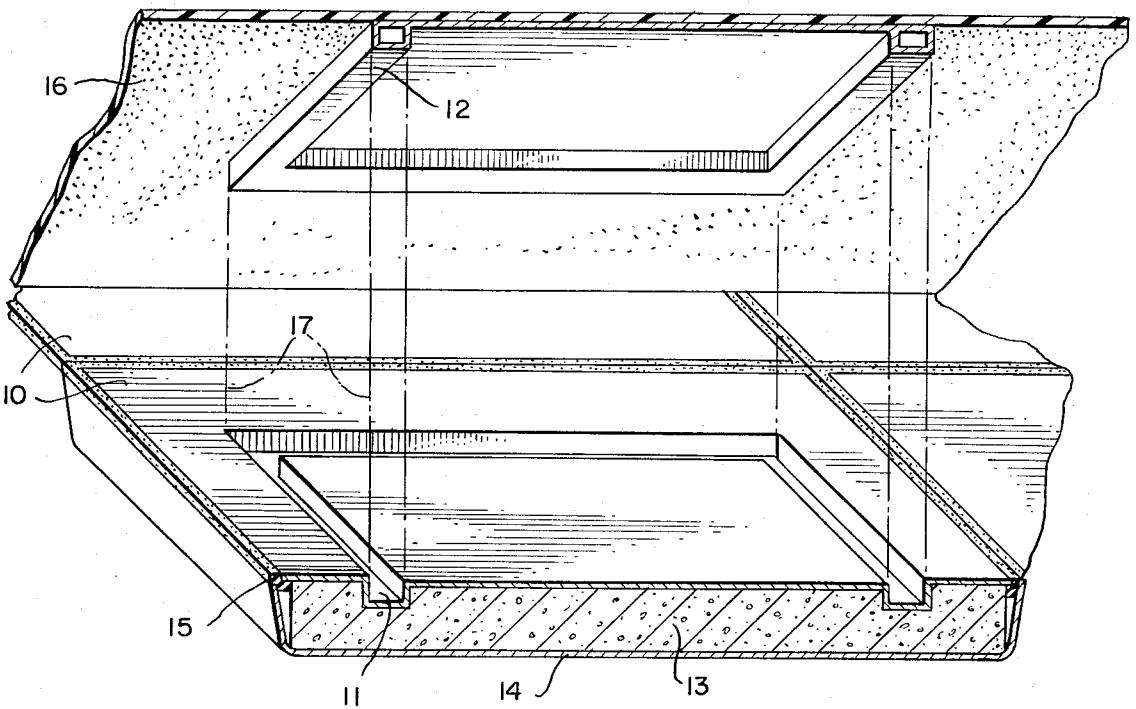
FIG. 1 is a partial-sectional isometric view of a floor system according to the present invention, showing the flooring sheet and attachment means lifted off the tiles.

Referring now to FIG. 1, tiles 10 are provided with a recess 11 in their upper surfaces. recess 11 is preferably square, but may have other shapes, for example, rectangular or circular. Attachment element 12 is attached to flooring sheet 16 which is shown peeled away from tiles 10. Attachment element 12 will closely fit within recess 11 when flooring sheet 16 is loweed upon tiles 10. The elevation of attachment element 12 coincides with the elevation of recess 11 so that the upper surface of attachment element 12 is flush with the upper surface of tile 10.

Tiles 10 may have a wood (such as high density particle board), concrete, or plastic core 13 and a metal skin 14. Attachment element 12 may be, for example, metal or plastic and they may be hollow or solid. Resilient edgings 15 around tiles 10 enable tiles 10 to be elastically butted against each other. Rubber is a suitable material for edging 15.

Figure 2:
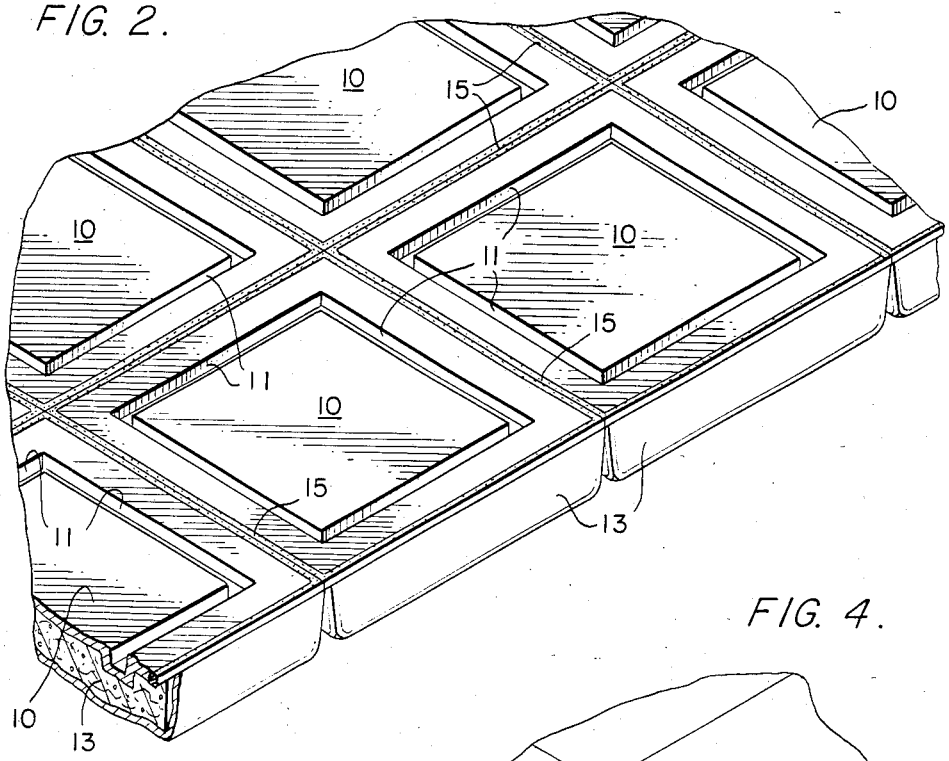
FIG. 2 is a partial-sectional, isomeric view of a plurality of tiles supported on a support grid in accordance with the present invention.
Figure 3:
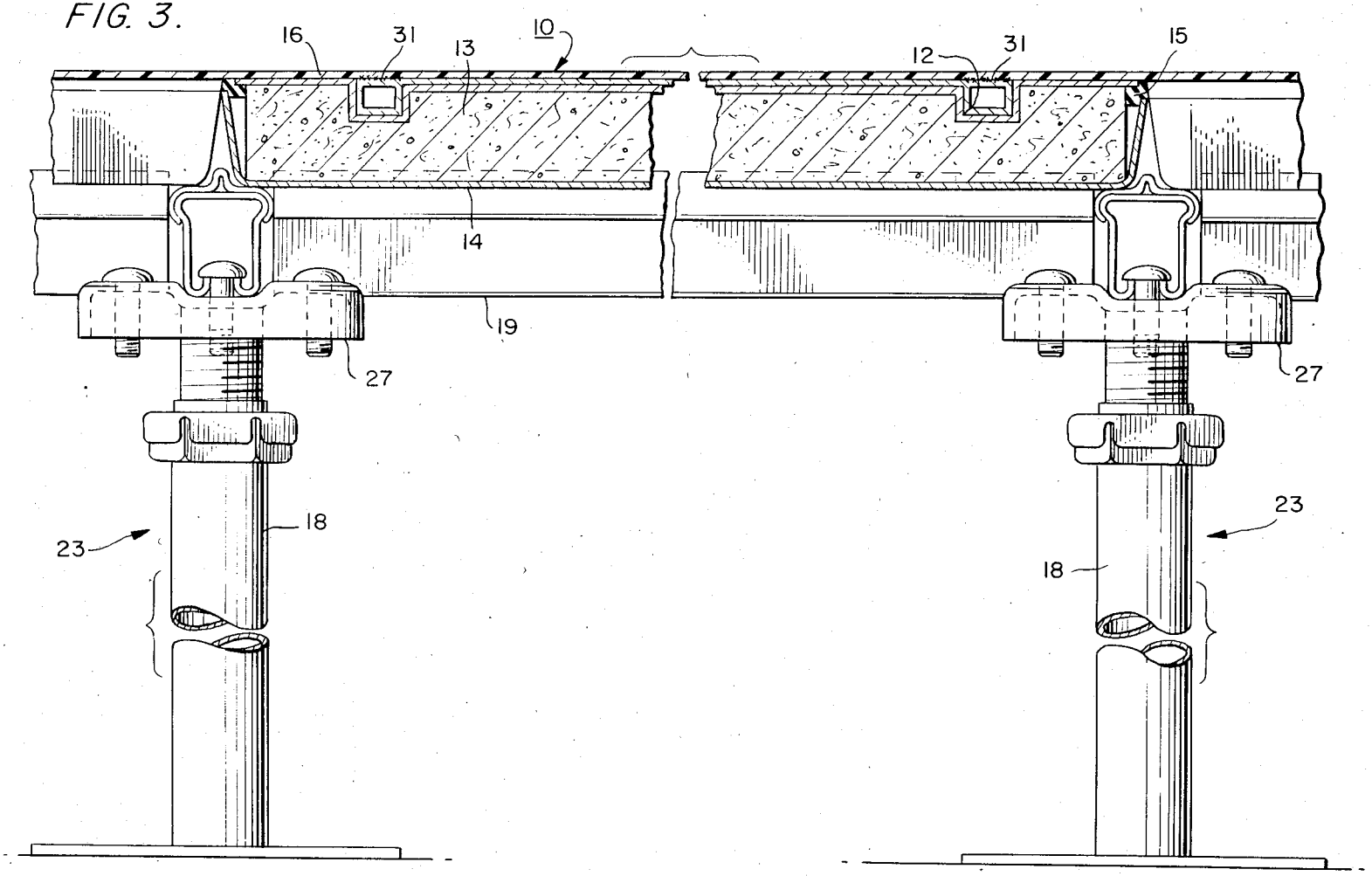
FIG. 3 is a partial-sectional, side view showing the entire floor system of the present invention with the flooring sheet supported on the tiles.

FIG. 2 illustrates a plurlaity of tiles 10 adjacent to one another and supported on a support grid such as that illustrated in FIG. 3.

As shown in FIG. 3, support grid 23 includes a network of pedestals 18 which supports stringers 19. Tiles 10 are laid flat on stringers 19. Flooring sheet 16, shown in FIG. 1, is supported on top of tiles 10. It should be noted that in the support grid 23 provided by pedestals 18 and stringers 19, four stringer ends are supported on each pedestal.

Figure 4:
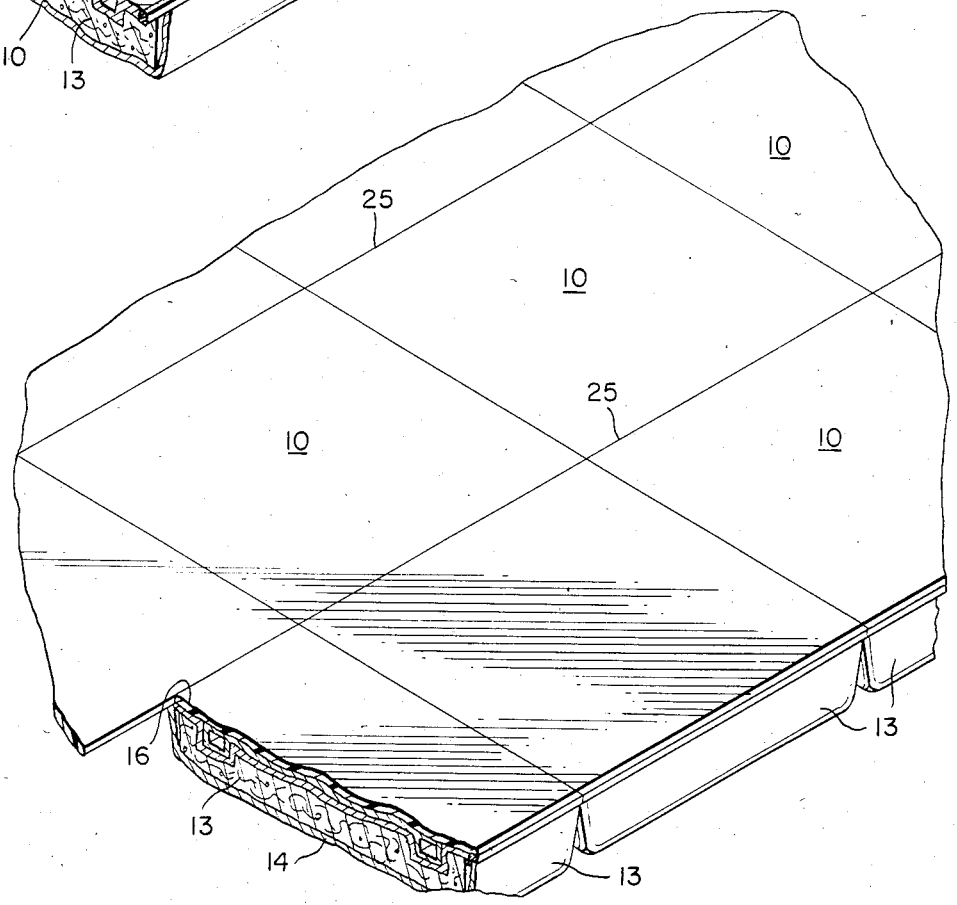
FIG. 4 is a isometric view of a flooring sheet having a grid on its top surface.

FIG. 4 illustrates a grid 25 which has been painted on the top surface of flooring sheet 16 preferably with epoxy paint, such that grid 25 substantially coincides with the borders of tiles 10 when flooring sheet 16 is placed onto tiles 10.

The preferred method of assembling the flooring system according to the present invention involves first laying tiles 10 on support grid 23, with at least one of tiles 10 having a recess 11 formed in its upper surface. Next, an anti-adhesvie coating such as a coating of light oil or other lubricant is applied to the top surfaces of tiles 10, including the surface of any recess 11 in a tile 10. Then an attachment element 12 is placed into recess 11. Subsequently, an adhesive substance is placed on the top surface of attachment element 12. Then, flooring sheet 16 is placed across tiles 10 such that sheet 16 is bonded to the attachment element 12 by the adhesive coating thereon. Finally, a grid 25 is preferably marked on the upper surface of flooring sheet 16 wherein grid 25 registers with the borders between tiles 10.

The coating on the top surfaces 17 of tiles 10, preferably a coating of a light oil, prevents the adhesive substance from sticking to surface 17 of tiles 10. Flooring sheet 16 is preferably a sheet vinyl which is heat resealable. Flooring sheet 16 may be formed of polyvinyl chloride or any type of vinyl-flooring that is heat resealable. Grid 25 is preferably painted on the top surface of flooring sheet 16 with epoxy paint.

It is to be understood that when any utility lines are channeled through the floor system of this invention that preferably a suitable seal will be made at the penetration site to maintain the waterproof integrity of the floor system. For example, a utility line may be passed through an aperture in the floor system and surrounded with a sealing or locking sleeve at the feed-through location (see under chamber 32 in FIG. 5). Alternatively, sealants such as silicone putties or caulkings can be employed to effect a seal around the utility line at the point where it passes through the floor system.

Figure 5:
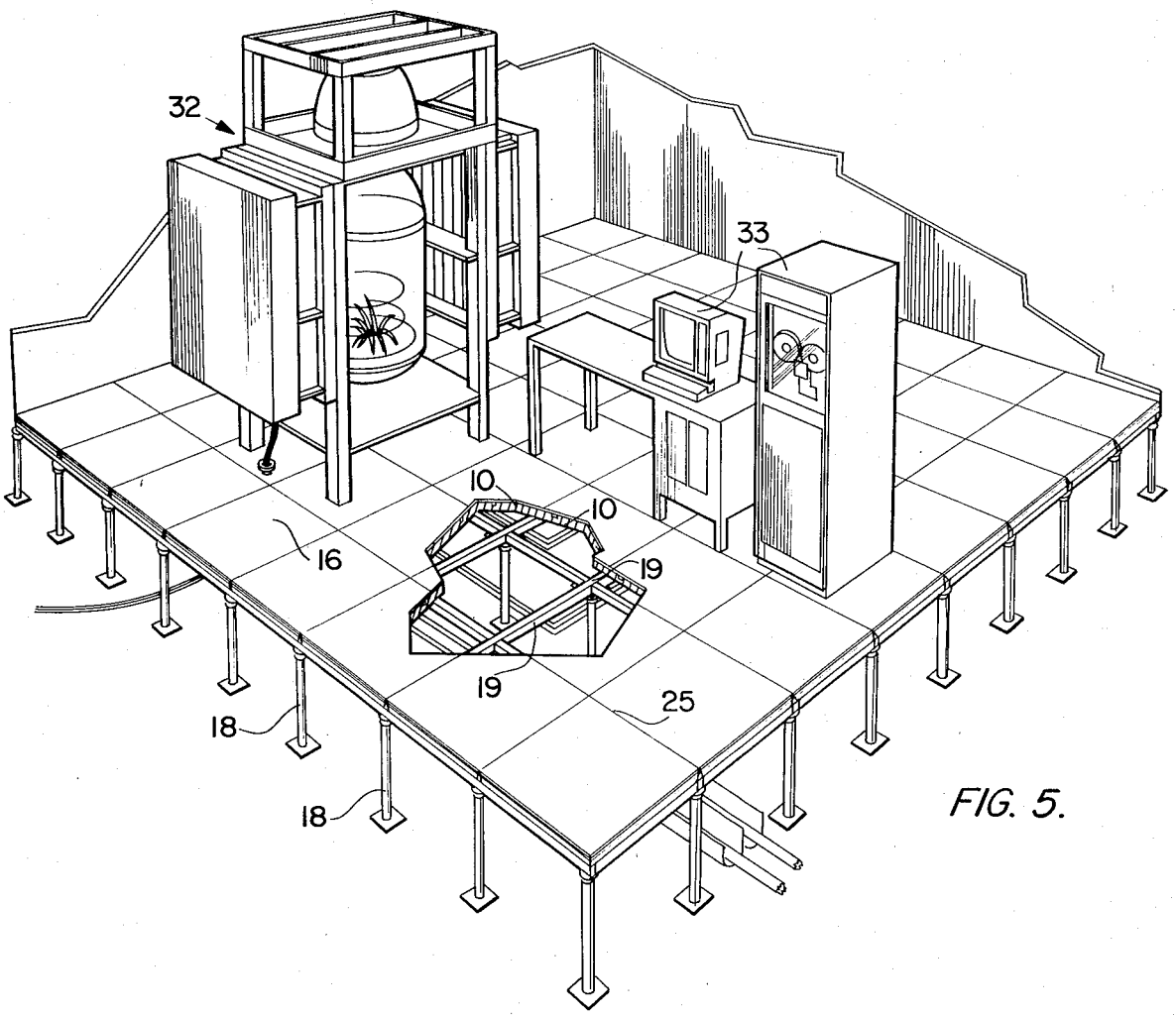
FIG. 5 is a pictorial representation of a laboratory utilizing the present invention.

FIG. 5 depicts a laboratory wherein a plant growth experiment is being conducted. A plant growth chamber 32 (including a light source, a humidity control syste, a temperature control system, etc.) and automatic data processing (ADP) equipment 33 are supported by an elevated waterproof access floor system constructed in accordance with the present invention.

When the floor system according to the present invention is to be penetrated in order to gain access to the subcavities, flooring sheet 16 is cut around one or more tiles 10 by following grid 25. The cut section of flooring sheet 16 is lifted off tiles 10, and tiles 10 are in turn lifted off support grid 23, i.e., off of stringers 19 and pedestals 18. After the subfloor work has been completed, tiles 10 and flooring sheet 16 can be replaced, and flooring sheet 16, which is preferably formed of a heat resealable material, can be resealed by heat application. Accordingly, the flooring system according to the present invention, even after penetration, maintains its waterproofing and its good aesthetic appearance.

It should be noted that recess 11 and attachment element 12 can be of any desired shape (circular, rectangular, etc.). Attachment element 12 is shown as a square frame in the figures. Accordingly, recess 11 is shown as a square with like dimensions. Further, because the function of recess 11 in cooperation with attachment element 12 is to prevent lateral motion of the flooring sheet 16 with respect to tiles 10 without hindering vertical motion therebetween, a recess 11 need only be provided in a sufficient number of tiles 10 to insure that such lateral motion is prevented. Thus, only one such recess 11 and attachment element 12 need be provided.

Tile 10, as an alternative to being provided with a light coating of oil on upper surface 17, could be provided with any material capable of preventing adhesion between flooring sheet 16 and tiles 10, for example, teflon. Similarly, attachment element 12 could be provided, as an alternative to an adhesive material, with any means capable of providing adherence between flooring sheet 16 and attachment element 12. Further, grid 25 could be a grooved or raised-bead pattern in flooring sheet 16. Further still, flooring sheet 16 could be made from transparent or translucent material and a noticeable grid 25 could be embedded therein.

Pedestals 18 can be provided with adjustment means 27 in order to provide a vertically adjustable floor system.

From the foregoing description, one skilled in the art can easily ascertain the essential characteristics of the present invention, and without departing from the spirit and scope thereof, can make various changes and modifications of the invention to adapt it to various usages and conditions.

What is claimed is:

1. An elevated waterproof access floor system that can be opened and subsequently resealed in a waterproof fashion without destroying its aesthetic appearance or the tiles used therein comprising: a support grid, a plurality of tiles supported on said grid, each tile having a recess for receiving an attachment element, a waterproof flooring sheet of heat-resealable material with attachment elements adhered to one surface of said heat-resealable material, said sheet supported on and covering said plurality of tiles with each attachment element mating with a respective tile recess to prevent lateral movement of said sheet with respect to said tiles.

2. An elevated waterproof access floor system. adapted such that it can be opened and subsequently resealed in a waterproof fashion without destroying its aesthetic appearance, comprising:

a support grid;

a plurality of tiles supported on said grid;

a flooring sheet supported on said tiles and being made of a heat-resealable material; and attachment means adapted to prevent lateral but not vertical movement of said flooring sheet with respect to said tiles, said attachment means comprising at least one recess formed in an upper surface of at least one of said tiles, and at least one attachment element attached to said flooring sheet such that when said sheet is supported on said tiles, said at least one attachment element fits closely and snugly into said at least one recess, a recess being formed in each of said tiles, and a plurality of attachment elements being attached to said flooring sheet such that an attachment element fits into each recess, said attachment elements being attached to said flooring sheet by adhesive means, the upper surfaces of said tiles except at said recess being provided with a substance to prevent adhesion between said flooring sheet and said tiles.

3. The floor system in accordance with claim 2 wherein said adhesion-preventing substance is a lubricant.

4. The floor system in accordance with claim 3 wherein said tiles comprise a rigid core covered with a metal skin.

5. The floor system in accordance with claim 4 wherein said tiles comprise a resilient edging to enable them to tightly fit against each other.

6. The floor system in accordance with claim 5 wherein said support grid comprises a plurality of pedestals having stringers supported thereon.

7. The floor system in accordance with claim 6 wherein said pedestals are vertically adjustable.

8. The floor system in accordance with claim 7 wherein a grid is disposed on the upper surface of said flooring sheet, said grid coinciding with the borders between said tiles.

9. A waterproof access floor system elevated above a subfloor that can be opened and subsequently resealed in a waterproof fashion without destroying its aesthetic appearance or tiles used therein comprising: a support grid elevated over said subfloor, a plurality of tiles supported on said support grid, said tiles comprising a metal-skin-covered core with upper and lower surfaces, a waterproof flooring sheet made of a heat-resealable material having upper and lower surfaces, a plurality of attachment elements adhered to said lower surface of said heatresealable material, said upper surface of each tile having a recess adapted to closely receive one of said attachment elements, said lower surface of said waterproof flooring sheet being supported on the upper surface of said tiles with said attachment elements engaged in said recesses to prevent lateral movement of said heat-resealable material with respect to said tiles.

10. An elevated waterproof access floor system as set forth in claim 9 wherein said recesses and said attachment elements have matching square shapes and wherein a grid is disposed on the upper surface of said flooring sheet that coincides with the borders between said tiles.

* * * * *